US010021494B2

(12) United States Patent
van Halteren et al.

(10) Patent No.: US 10,021,494 B2
(45) Date of Patent: Jul. 10, 2018

(54) HEARING DEVICE WITH VIBRATION SENSITIVE TRANSDUCER

(71) Applicant: Sonion Nederland B.V., Hoofddorp (NL)

(72) Inventors: Aart Zeger van Halteren, Hoofddorp (NL); Hamidreza Taghavi, Hoofddorp (NL)

(73) Assignee: Sonion Nederland B.V., Hoofddorp (NL)

( * ) Notice: Subject to any disclaimer, the term of this patent is extended or adjusted under 35 U.S.C. 154(b) by 0 days.

(21) Appl. No.: 15/292,317

(22) Filed: Oct. 13, 2016

(65) Prior Publication Data

US 2017/0111747 A1 Apr. 20, 2017

(30) Foreign Application Priority Data

Oct. 14, 2015 (EP) ..... 15189769

(51) Int. Cl.
*H04R 25/00* (2006.01)
*G10L 25/78* (2013.01)

(52) U.S. Cl.
CPC ..... *H04R 25/606* (2013.01); *G10L 25/78* (2013.01); *H04R 25/505* (2013.01); *H04R 2225/33* (2013.01)

(58) Field of Classification Search
CPC ..... H04R 25/606; A61N 1/36038
USPC ..... 181/135; 381/57, 94.1, 110, 314, 315, 381/326, 330, 318; 455/575.6; 600/418, 600/25; 324/318; 704/275
See application file for complete search history.

(56) References Cited

U.S. PATENT DOCUMENTS 4,903,703 A * 2/1990 Igarashi ..... A61B 5/055 324/318
5,298,692 A * 3/1994 Ikeda ..... H04R 1/1016 181/135
5,910,997 A * 6/1999 Ishige ..... H04R 25/505 381/312
6,788,796 B1 9/2004 Miles et al.
6,831,577 B1 12/2004 Furst
(Continued)

FOREIGN PATENT DOCUMENTS

EP 1519625 A2 3/2005
EP 1519625 A3 12/2006
(Continued)

OTHER PUBLICATIONS

European Search Report corresponding to co-pending European Patent Application, European Patent Office, dated Mar. 24, 2016; (2 pages).

*Primary Examiner* — Gerald Gauthier
(74) *Attorney, Agent, or Firm* — Nixon Peabody LLP

(57) ABSTRACT

A hearing device, such as a hearing aid, having a vibration sensitive transducer being adapted to detect vibrations being generated by a human voice, and a digital signal processor for processing signals from the vibration sensitive transducer in order to identify a predetermined human voice vibration signal being related to the voice of the user of the hearing device, and control the hearing device in accordance therewith. The vibration sensitive transducer is secured directly to a shell so that vibrations are detected via a skull of the user of the hearing device. An automatic method for controlling a hearing device, such as a hearing aid, is also disclosed.

22 Claims, 3 Drawing Sheets

(56) References Cited

U.S. PATENT DOCUMENTS 6,853,290 B2 2/2005 Jorgensen et al.
6,859,542 B2 2/2005 Johannsen et al.
6,888,408 B2 5/2005 Furst et al.
6,914,992 B1 7/2005 van Halteren et al.
6,919,519 B2 7/2005 Ravnkilde et al.
6,930,259 B1 8/2005 Jorgensen et al.
6,943,308 B2 9/2005 Ravnkilde et al.
6,974,921 B2 12/2005 Jorgensen et al.
7,008,271 B2 3/2006 Jorgensen
7,012,200 B2 3/2006 Moller
7,062,058 B2 6/2006 Steeman et al.
7,062,063 B2 6/2006 Hansen et al.
7,072,482 B2 7/2006 Van Doorn et al.
7,088,839 B2 8/2006 Geschiere et al.
7,110,560 B2 9/2006 Stenberg
7,136,496 B2 11/2006 van Halteren et al.
7,142,682 B2 11/2006 Mullenbom et al.
7,181,035 B2 2/2007 van Halteren et al.
7,190,803 B2 3/2007 van Halteren
7,206,428 B2 4/2007 Geschiere et al.
7,221,767 B2 5/2007 Mullenborn et al.
7,221,769 B1 5/2007 Jorgensen
7,227,968 B2 6/2007 van Heltren et al.
7,239,714 B2 7/2007 de Blok et al.
7,245,734 B2 7/2007 Niederdraenk
7,254,248 B2 8/2007 Johannsen et al.
7,286,680 B2 10/2007 Steeman et al.
7,292,700 B1 11/2007 Engbert et al.
7,292,876 B2 11/2007 Bosh et al.
7,336,794 B2 2/2008 Furst et al.
7,376,240 B2 5/2008 Hansen et al.
7,403,630 B2 7/2008 Jorgensen et al.
7,415,121 B2 8/2008 Mögelin et al.
7,425,196 B2 9/2008 Jorgensen et al.
7,460,681 B2 12/2008 Geschiere et al.
7,466,835 B2 12/2008 Stenberg et al.
7,492,919 B2 2/2009 Engbert et al.
7,548,626 B2 6/2009 Stenberg et al.
7,657,048 B2 2/2010 van Halteren et al.
7,684,575 B2 3/2010 van Halteren et al.
7,706,561 B2 4/2010 Wilmink et al.
7,715,583 B2 5/2010 Van Halteren et al.
7,728,237 B2 6/2010 Pedersen et al.
7,809,151 B2 10/2010 Van Halteren et al.
7,822,218 B2 10/2010 Van Halteren
7,899,203 B2 3/2011 Van Halteren et al.
7,912,240 B2 3/2011 Madaffari et al.
7,946,890 B1 5/2011 Bondo et al.
7,953,241 B2 5/2011 Jorgensen et al.
7,961,899 B2 6/2011 Van Halteren et al.
7,970,161 B2 6/2011 van Halteren
8,098,854 B2 1/2012 van Halteren et al.
8,101,876 B2 1/2012 Andreasen et al.
8,103,039 B2 1/2012 van Halteren et al.
8,160,290 B2 4/2012 Jorgensen et al.
8,170,249 B2 5/2012 Halteren
8,189,804 B2 5/2012 Hruza
8,189,820 B2 5/2012 Wang
8,223,996 B2 7/2012 Beekman et al.
8,233,652 B2 7/2012 Jorgensen et al.
8,259,963 B2 9/2012 Stenberg et al.
8,259,976 B2 9/2012 van Halteren
8,259,977 B2 9/2012 Jorgensen et al.
8,280,082 B2 10/2012 van Halteren et al.
8,284,966 B2 10/2012 Wilk et al.
8,313,336 B2 11/2012 Bondo et al.
8,315,422 B2 11/2012 van Halteren et al.
8,331,595 B2 12/2012 van Halteren
8,369,552 B2 2/2013 Engbert et al.
8,379,899 B2 2/2013 van Halteren et al.
8,509,468 B2 8/2013 van Halteren et al.
8,526,651 B2 9/2013 Lafort et al.
8,526,652 B2 9/2013 Ambrose et al.
8,767,989 B2 7/2014 Burns et al.
8,811,637 B2 8/2014 Burns et al.
8,879,763 B2 11/2014 Burns et al.
9,042,586 B2 5/2015 Burns et al.
2002/0076073 A1* 6/2002 Taenzer ..... H04R 25/502 381/315
2002/0081982 A1* 6/2002 Schwartz ..... H04B 1/385 455/575.6
2008/0175399 A1* 7/2008 Kim ..... H03G 3/32 381/57
2008/0292126 A1* 11/2008 Sacha ..... H04R 25/02 381/330
2010/0008527 A1* 1/2010 Gottschalk ..... H04R 25/554 381/315
2010/0246866 A1* 9/2010 Swain ..... H04R 25/505 381/315
2011/0112355 A1* 5/2011 Van den Heuvel ..... A61N 1/36032 600/25
2011/0182453 A1 7/2011 van Hal et al.
2011/0189880 A1 8/2011 Bondo et al.
2011/0299708 A1 12/2011 Bondo et al.
2011/0299712 A1 12/2011 Bondo et al.
2011/0311069 A1 12/2011 Ambrose et al.
2012/0014548 A1 1/2012 van Halteren
2012/0027245 A1 2/2012 van Halteren et al.
2012/0140966 A1 6/2012 Mocking et al.
2012/0155683 A1 6/2012 van Halteren
2012/0155694 A1 6/2012 Reeuwijk et al.
2012/0255805 A1 10/2012 van Halteren et al.
2013/0028451 A1 1/2013 de Roo
2013/0136284 A1 5/2013 van Hal et al.
2013/0142370 A1 6/2013 Engbert et al.
2013/0163799 A1 6/2013 Van Halteren
2013/0195295 A1 8/2013 van Halteren et al.
2013/0343584 A1 12/2013 Bennett et al.
2013/0343585 A1* 12/2013 Bennett ..... H04R 25/554 381/315
2014/0029762 A1* 1/2014 Xie ..... H04R 5/027 381/94.1
2014/0275729 A1* 9/2014 Hillbratt ..... H04R 25/552 600/25
2014/0337036 A1* 11/2014 Haiut ..... G06F 1/3265 704/275
2015/0043762 A1 2/2015 Kim et al.
2015/0078600 A1* 3/2015 Rasmussen ..... H04R 25/405 381/318
2015/0341717 A1* 11/2015 Song ..... H04R 1/08 381/110
2017/0111747 A1* 4/2017 van Halteren ..... H04R 25/606
2018/0036539 A1* 2/2018 Banna ..... A61N 1/36036

FOREIGN PATENT DOCUMENTS

WO WO 93/23944 A1 11/1993
WO WO 2015/110587 A1 7/2015

* cited by examiner

HEARING DEVICE WITH VIBRATION SENSITIVE TRANSDUCER

CROSS-REFERENCE TO RELATED APPLICATION

This application claims the benefit of European Patent Application Serial No. 15189769.1, filed Oct. 14, 2015, and titled "Hearing Device With Vibration Sensitive Transducer," which is incorporated herein by reference in its entirety.

FIELD OF THE INVENTION

The present invention relates to a reliable power saving arrangement for hearing devices, including increased comfort for the users of the hearing devices. In particular, the present invention relates to an automatic manner of switching a hearing device on and/or off using a predetermined human voice vibration signal, or to bring the hearing device in and/or out of a power saving state using the predetermined human voice vibration signal.

BACKGROUND OF THE INVENTION

Various automatic power saving arrangements for hearing devices have been suggested over the years. However, many of the suggested arrangements are unreliable in that they switch the hearing devices on and/or off at inappropriate times which is very annoying for the user of the hearing device. Thus, there seems to be a need for reliable automatic power saving arrangements for hearing devices in order for the hearing aid batteries to last longer. Moreover, there seems to be a need for reliable automatic power saving arrangements for hearing devices for increasing the comfort for the hearing device users, and for making the hearing devices more user-friendly.

Examples of prior art arrangements are disclosed in for example U.S. Pat. No. 9,042,586 B2, U.S. Pat. No. 8,879,763 B2, U.S. Pat. No. 8,811,637 B2 and U.S. Pat. No. 8,767,989 B2.

It may be seen as an object of embodiments of the present invention to provide a reliable power saving arrangement for hearing devices, such as hearing aids.

SUMMARY OF INVENTION

The above-mentioned object is complied with by providing, in a first aspect, a hearing device comprising

- a vibration sensitive transducer being adapted to detect vibrations being generated by a human voice, and
- a digital signal processor for processing signals from the vibration sensitive transducer in order to identify a predetermined human voice vibration signal being related to the voice of the user of the hearing device, and control the hearing device in accordance therewith wherein the vibration sensitive transducer is secured to a shell of the hearing device so that vibrations are detected via a skull of the user of the hearing device.

Thus, the present invention relates to a voice controlled power saving arrangement for hearing devices. In the present context voice generated vibrations should be understood as any type of vibration being generated by the vocal cords of the user of the hearing device, including speech, growl, humming etc.

It is advantageous that by proper signal processing within the DSP the hearing device may only react on the voice of the user of the hearing device in that the DSP may be adapted to apply a voice recognition algorithm to determine the predetermined human voice vibration signal, in particular the voice of the user of the hearing device.

Voice generated vibrations may be present only in a certain frequency band. Moreover, voice generated vibrations may often be comparable to a typical background noise level. Thus, in order for the voice recognition algorithm to operate properly the vibration sensitive transducer must have low noise properties as well as a certain frequency response in terms of sensitivity, damping and low frequency roll off.

The DSP may be a discrete device, or it may form an integral part of the vibration sensitive transducer. In case of a discrete DSP the DSP may be applied for various signal processing within the hearing device, such as signal processing of signals from a microphone or signals to be provided to a receiver. In case of a vibration sensitive transducer comprising an integrated DSP this DSP may process only vibrations signals, and optionally control another DSP of the hearing device.

The DSP may be configured to switch the hearing device on when the predetermined human voice vibration signal is detected. As previously stated the predetermined human voice vibration signal is related to the voice of the user of the hearing device. The DSP may also be configured to switch the hearing device off when the predetermined human voice vibration signal is not detected in a predetermined time period. Again, the predetermined human voice vibration signal is related to the voice of the user of the hearing device.

The hearing device may further comprise a microphone unit for receiving incoming acoustical signals and a receiver unit for reproducing the incoming acoustical signals.

The vibration sensitive transducer may be configured to detect human voice generated vibrations via the skull of the user of the hearing device. In achieve this, the hearing device may further comprise a shell being adapted to abut the skin of the skull of the user of the hearing device. In order to detect human voice generated vibrations the vibration sensitive transducer may be mechanically connected to said shell, either directly secured to the shell, or connected via a mechanically rigid connection.

In terms of positioning the vibration sensitive transducer may be positioned in the shell at a point where the voice generated vibrations are dominant, while other types of vibrations, such as receiver generated vibrations, are essentially zero.

During operation the shell of the hearing device may be adapted to be positioned between the vibration sensitive transducer and the skull of the user of the hearing device. Thus, the shell of the hearing device may be adapted to abut the skin of the skull on one side of the shell, while the vibration sensitive transducer is secured to the opposite side of the shell.

The hearing device of the present invention may further comprise additional transducers, such as accelerometers, rotation sensors and/or gyroscopes. Such additional transducers may be advantageous in case the user of the hearing device has a poor bone conduction transmission through the skull bone. Moreover, additional transducers may be applied for measuring additional user-related activities, such as foot-step counting, fitness and health related indicators etc.

The term hearing device should be understood as any device being capable of increasing the hearing capability of a human being. Thus, the term hearing device may comprise, among other devices, hearing aids being selected from the group consisting of: behind-the-ear, in-the-ear, in-the-canal, invisible-in-canal and completely-in-canal.

In a second aspect the present invention relates to a method for operating a hearing device comprising a vibration sensitive transducer being operatively connected to a DSP, the method comprising the steps of detecting a predetermined human voice vibration signal using the vibration sensitive transducer and the signal processing capability of the DSP, and controlling the hearing device in accordance with the detected predetermined human voice vibration signal.

wherein the predetermined human voice vibration signal is associated with the voice of the user of the hearing device, and wherein the vibration sensitive transducer is adapted to detect vibrations via a skull of the user of the hearing device.

Again, the term hearing device should be understood as any device being capable of increasing the hearing capability of a human being. This may include hearing aids being selected from the group consisting of: behind-the-ear, in-the-ear, in-the-canal, invisible-in-canal and completely-in-canal.

The predetermined human voice vibration signal may be determined using a voice recognition algorithm within the DSP. As mentioned in relation to the first aspect the DSP may be a discrete and multi-purpose component of the hearing device, or it may form an integral part of the vibration sensitive transducer.

In terms of controlling the hearing device may be switched on when the predetermined human voice vibration signal is detected. Likewise, the hearing device may be switched off when the predetermined human voice vibration signal is not detected in a predetermined time period. Similar to the first aspect the predetermined human voice vibration signal is associated with the voice of the user of the hearing device. Thus, in terms of controlling, such bringing the hearing device into or out of a power saving state, the hearing device may be configured to react only on the voice of its user, i.e. the person wearing the hearing device.

The predetermined human voice vibration signal may be detected via the skull of the user of the hearing device by positioning the vibration sensitive transducer in mechanical contact with a shell of the hearing device as explained in relation to the first aspect of the present invention.

BRIEF DESCRIPTION OF THE DRAWINGS

The present invention will now be described in further details with reference to the accompanying figures, wherein.

Figure 1:
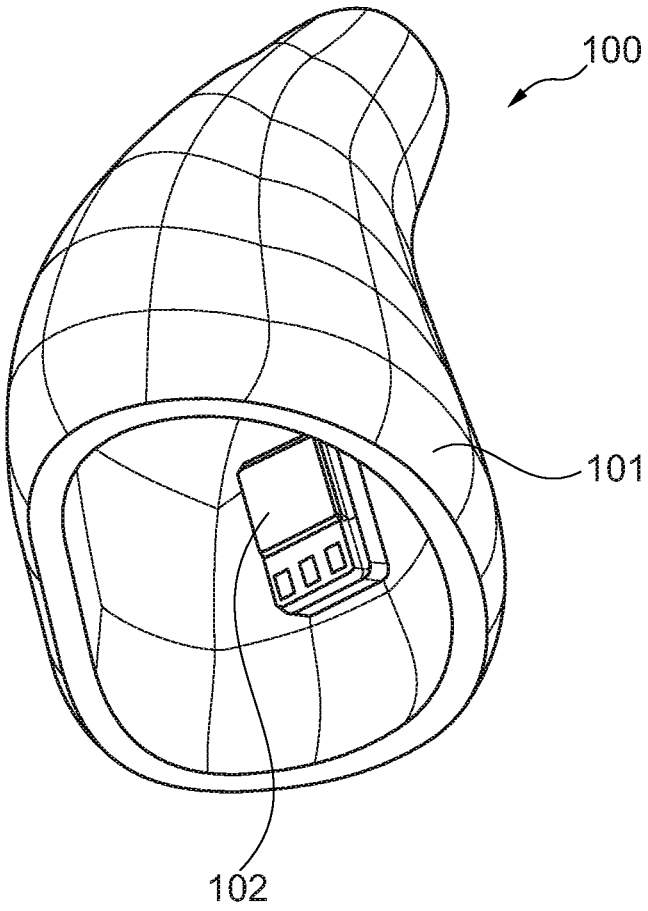
FIG. 1 shows part of an in-the-canal hearing aid including a vibration sensor.

While the invention is susceptible to various modifications and alternative forms specific embodiments have been shown by way of examples in the drawings and will be described in details herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF PREFERRED EMBODIMENTS

In its broadest aspect the present invention relates to a hearing device, such as a hearing aid, and an associated method where a human voice generated vibration signal is using to control the hearing device in a power saving manner. The human voice generated vibration signal is provided by a vibration sensitive transducer and an appropriate signal processing algorithm of a DSP within the hearing device. The processing of the vibration signal may be performed by a discrete DSP of the hearing device, or it may be performed by a DSP being integrated with for example the vibration sensitive transducer.

The vibration sensitive transducer, such as an electret vibration sensor, is provided for sensing voice generated vibrations via the skull of the user of the hearing device. A suitable approach for providing the human voice generated vibration signal is to apply a voice recognition algorithm to the signal from the vibration sensitive transducer. The voice recognition algorithm may apply a modulation analysis scheme in that human voice modulation is a very unique identifier. By following this approach the hearing device will only respond to voice vibrations originating from the user of the hearing device.

In terms of controlling, the hearing device may for example be switched on or switched off in response to vibrations being generated by the user's voice. However, other control schemes are also applicable as it will be disclosed in the following.

Figure 2:
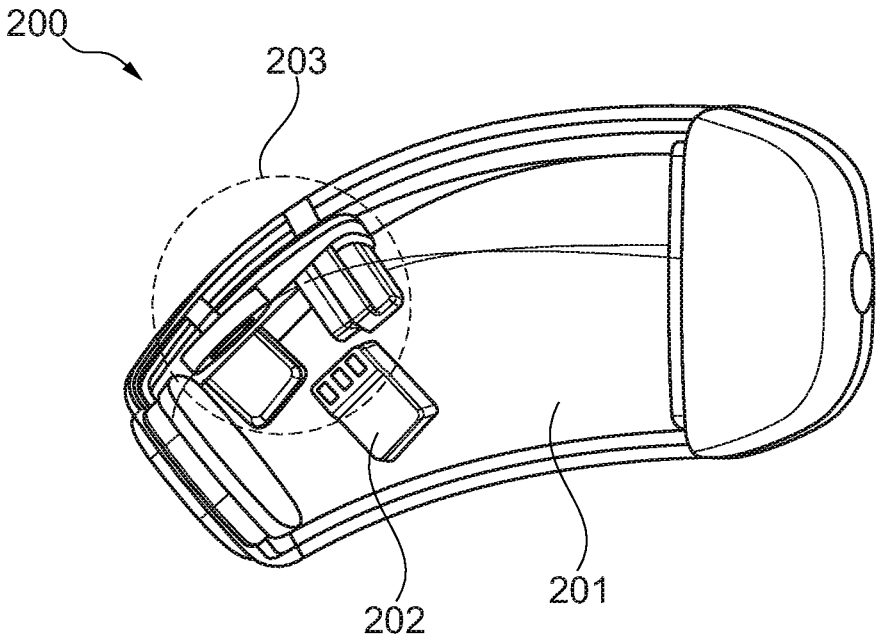
FIG. 2 shows part of a behind-the-ear hearing aid including a vibration sensor.
Figure 3:
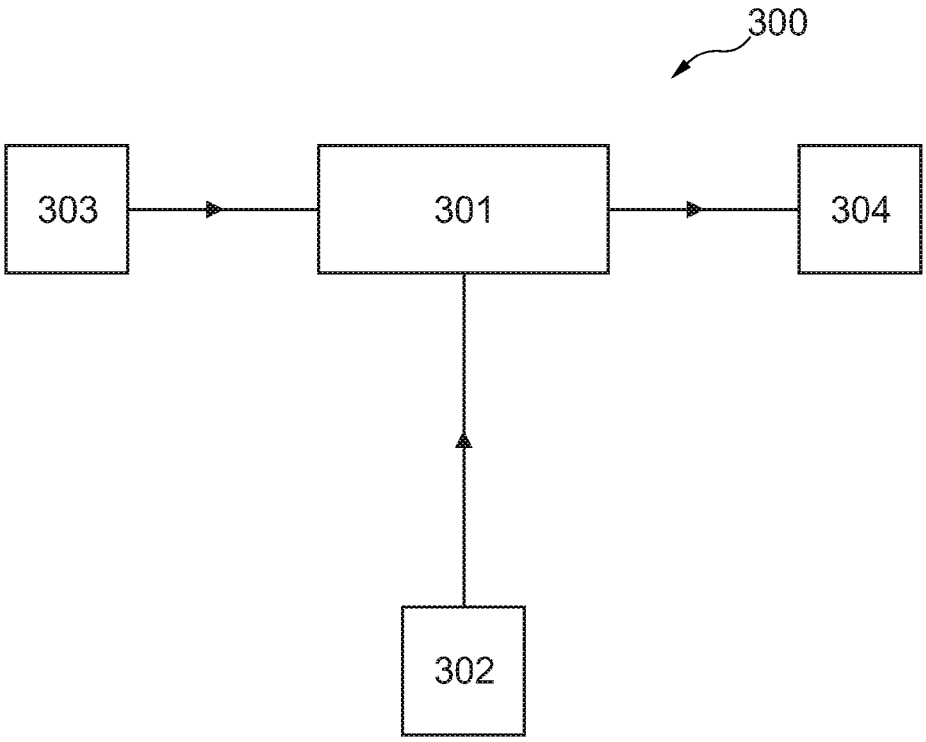
FIG. 3 shows a simplified electrical block diagram.

Referring now to FIG. 1 a part of an in-the-canal hearing aid 100 is depicted. As seen in FIG. 1 the vibration sensor 102 is secured directly to the shell 101 of the hearing aid. In this way human voice generated vibrations may be detected when the shell is positioned in the ear canal. In FIG. 2 a part of a behind-the-ear hearing aid 200 is depicted. As seen the vibration sensor 202 is secured directly to the shell 201 so that vibrations may be detected via the skull when the hearing device 200 is positioned behind the ear. Additional electronic components 203 are also shown in FIG. 2. FIG. 3 shows a simplified electronic block diagram 300. The block diagram 300 shows a DSP 301 being adapted to process signals from a microphone 303 before forwarding it to the receiver 304 for reproduction. A vibration sensor 302 is provided for sensing voice generated vibrations. The vibration sensor 302 is operatively connected to the DSP 301 so that the software provided therein may be used to process the vibration signals in order to identify predetermined human voice vibration signals. Such signals may be identified using voice recognition programs, including for example modulation analysing programs. The DSP is configured to control the hearing device in response to the detection of the predetermined human voice vibration signals, cf. the description below.

The signal from the vibration sensitive transducer may be passed through a band-pass filter in order to remove noises and disturbances.

Generally, a hearing device may apply a vibration sensitive transducer for automatic on/off control as well as other ways to change the power state of the hearing device. The various vibration-based control scenarios may be divided as follows:

1) Basic setup
2) Using sleep mode
3) Using other sensors
4) Using wired or wireless recharging
5) Improvements The basic setup has already been disclosed above, i.e. an arrangement for automatic on/off control of a hearing device. Such an arrangement can only work in a reliable manner if a characteristic being unique to a human being can be applied, in particular a parameter that has a unique range.

One possible approach to gain information would be to pick-up the vibrations generated by a human voice in the ear-canal using the vibration sensor, such as an electret vibration sensor which is hermetically closed. In an electret vibration sensor a moving back-plate is used to get a large moving mass and thus the required sensitivity. A MEMS-based vibration sensor may be applicable as well despite its lower sensitivity.

The Basic Setup:

The vibration sensor requires mechanical contact to the human skull through either the skin in the ear-canal, or the skin around the ear in case of a BTE. The vibration sensor is always switched on, but uses only very little current (down to 2 μA). Thus, when the hearing device is positioned in a drawer, on a table or in another position where it is not in vibrational contact with a human being, only a very little amount of electrical power is used. The remaining components of the hearing device use very little power as well. For example only part of the DSP is applied to process the signal from the vibration sensor. A significant amount of power can also be saved by only processing the vibration sensor signal at a low duty cycle, and only if the vibration sensor signal is above a certain level. The total quiescent current may be as low as 20 μA.

If the signal from the vibration sensor is above a certain level the DSP will determine if the signal resembles a human voice using the same software as used for classifying the acoustic scene in the hearing device. For instance the DSP software may analyze the modulation of the vibration sensor signal since the human voice has a very unique modulation. If the vibration signal does not resembling the human voice no change of the state of operation of the hearing device is provided. On the other hand if the voice of the user of the hearing device is recognized, then the hearing device will switch on, assuming that it is positioned in either 1) the ear-canal or 2) on/behind the ear. The hearing device stays in the on-state for at least a certain time of period, say for example 30 minutes. During this period of time the hearing device will at least once process the vibration signal again and act in response thereto.

If the user of the hearing device has been silent for a period of time the hearing device will provide a warning signal, such as a beep or a message, before eventually switching off. The beep or message informs the user that the hearing device will switch off within a certain period of time, such as within one a minute. Then the hearing device goes into a super sensitive mode to detect a swallow, scratching throat or other patterns as a special event. If the user of the hearing device reacts to the warning signal by in somehow using his/hers voice or any predetermined patterns, the hearing device will stay switched on. It should be noted however that other control schemes are applicable as well. If the user of the hearing device does not react on the warning signal, the hearing device will switch off in order to save power.

To make the hearing device a user-friendly device, it will provide a beep or the like when starting up since the typical startup cycle might take 10 seconds for some hearing aids. The user might get confused if he puts the hearing device in his ear-canal or on/behind his ear. The user of the hearing device must be instructed to in somehow use his voice (scratch the throat, say any word etc.). This way of controlling the hearing device is completely reliable in that if a third person talks to the user of the hearing device, and the user does not understand, the user will say at least some words which will initiate switch on of the hearing device. The hearing device will then provide a beep or the like and subsequently startup. The user of the hearing device will then be able to hear again.

The Sleep Mode:

In order to save power, modern microphones/vibration sensors may have a build-in sleep mode. In this sleep mode they use only very little power, i.e. a very low average current where the performance is low as well. Alternatively, the power saving mode may be provided by operating at a low duty cycle. Even in this power saving mode modern microphones/vibration sensors can wake up and are still able to process the voice identification on their own. In that case the DSP is completely switched off and all the intelligence is positioned in the modern microphone/vibration sensor for switching the hearing device on. However, the DSP still plays a role when the hearing device is to be switched off.

Alternatively, the DSP itself can also have a sleep mode. For example when the user of the hearing device does not use his voice above a certain level perhaps for some time, it must be assumed that the user is also in a situation where speech communication is not taking place, or at least is less important. If the user of the hearing device does not communicate, uses his/hers voice, then the user related voice level picked-up by the hearing device decreases and the acoustical signal processing can be used for switching the DSP to a sleep mode. The hearing device then goes into a power saving mode with reduced processing. For example the hearing device could switch off all advanced signal processing. The same algorithms may be applied for voice detection as well.

Thus, according to the present invention the vibration sensor may be used to switch the DSP into a sleep mode. The hearing device will leave the sleep mode when the user of the hearing device uses his voice above a certain sound level.

Another interesting possibility would be to use the same setup to open and close a valve. The following approach could be imagined in relation to anti-occlusion: If the user of the hearing device uses his voice a valve could open (and have no occlusion). When the user of the hearing device stops talking the valve is closed which enables very high gain.

Using Other Types of Sensors:

In general, the process of putting the hearing device in a different power state could also be initiated by other types of sensors, such as for example rotation sensors, accelerometers, gyroscopes or other sensors that are capable of indicating that the hearing device in somehow moves. The overall functioning would however be the same as in the case of a vibration sensor.

Wired or Wireless Charging:

When using wireless or wired charging, the hearing device will know that it is in a charging mode and can always be switched off in that situation.

Improvements:

During fitting of the hearing device, or after any startup of the hearing device the classification software can be calibrated to the user. For instance each hearing device user has a different spectrum for the vibration which is pretty unique. The combination of the basic resonance frequency in the low frequency end, the higher resonances due to the size and mechanical behavior of the ear canal, the mechanical transmission paths between where the user's voice is generated and where the vibration signal is picked up, defines a unique 'finger print'. This may also help in relation to the very small percentage of hearing device users that have a much lower vibration transmission. In this case, a software backup is needed, for example the user of the hearing device can tap on the hearing device to avoid sleep mode or switching off the device. There might be cases where one has to switch off the system and rely on other things.

The invention claimed is:

1. A hearing device comprising a vibration sensitive transducer being adapted to detect vibrations being generated by a human voice, and a digital signal processor for processing signals from the vibration sensitive transducer in order to identify a predetermined human voice vibration signal being related to the voice of the user of the hearing device, and control the hearing device in accordance therewith wherein the vibration sensitive transducer is secured to a shell of the hearing device so that vibrations are detected via a skull of the user of the hearing device.

2. A hearing device according to claim 1, wherein the digital signal processor is adapted to apply a voice recognition algorithm to determine the predetermined human voice vibration signal.

3. A hearing device according to claim 1, wherein the digital signal processor is a discrete device, or wherein the digital signal processor forms an integral part of the vibration sensitive transducer.

4. A hearing device according to claim 1, wherein the digital signal processor is configured to switch the hearing device on when the predetermined human voice vibration signal is detected.

5. A hearing device according to claim 1, wherein the digital signal processor is configured to switch the hearing device off when the predetermined human voice vibration signal is not detected in a predetermined time period.

6. A hearing device according to claim 1, further comprising a microphone unit for receiving incoming acoustical signals and a receiver unit for reproducing the incoming acoustical signals.

7. A hearing device according to claim 1, wherein vibration sensitive transducer is configured to detect human voice generated vibrations via the skull of the user of the hearing device.

8. A hearing device according to claim 1, wherein the vibration sensitive transducer is mechanically secured directly to the shell of the hearing device.

9. A hearing device according to claim 1, further comprising additional transducers, such as accelerometers, rotation sensors and/or gyroscopes.

10. A hearing device according to claim 1, said hearing device comprising a hearing aid being selected from the group consisting of: behind-the-ear, in-the-ear, in-the-canal, invisible-in-canal and completely-in-canal.

11. A hearing device according to claim 1, wherein the shell of the hearing device is adapted to be positioned between the vibration sensitive transducer and the skull of the user of the hearing device.

12. A hearing device according to claim 2, further comprising a controllable valve, and wherein the digital signal processor is configured to open the valve when the predetermined human voice vibration signal is detected, and wherein the digital signal processor is configured to close the valve when the predetermined human voice vibration signal is not detected.

13. A method for operating a hearing device comprising a vibration sensitive transducer being operatively connected to a digital signal processor, the method comprising the steps of detecting a predetermined human voice vibration signal using the vibration sensitive transducer and the signal processing capability of the digital signal processor, and controlling the hearing device in accordance with the detected predetermined human voice vibration signal wherein the predetermined human voice vibration signal is associated with the voice of the user of the hearing device, and wherein the vibration sensitive transducer is adapted to detect vibrations via a skull of the user of the hearing device.

14. A method according to claim 13, wherein the predetermined human voice vibration signal is determined using a voice recognition algorithm within the digital signal processor.

15. A method according to claim 13, wherein the hearing device is switched on when the predetermined human voice vibration signal is detected.

16. A method according to claim 13, wherein the hearing device is switched off when the predetermined human voice vibration signal is not detected in a predetermined time period.

17. A hearing device according to claim 4, wherein the digital signal processor is configured to switch the hearing device off when the predetermined human voice vibration signal is not detected in a predetermined time period.

18. A hearing device according to claim 2, wherein vibration sensitive transducer is configured to detect human voice generated vibrations via the skull of the user of the hearing device.

19. A hearing device according to claim 7, wherein the vibration sensitive transducer is mechanically secured directly to the shell of the hearing device.

20. A hearing device according to claim 2, wherein the digital signal processor is a discrete device, or wherein the digital signal processor forms an integral part of the vibration sensitive transducer.

21. A hearing device according to claim 20, wherein the digital signal processor is configured to switch the hearing device on when the predetermined human voice vibration signal is detected.

22. A communication device comprising a vibration sensitive transducer being adapted to detect vibrations being generated by a human voice, and a digital signal processor for processing signals from the vibration sensitive transducer in order to identify a predetermined human voice vibration signal being related to the voice of the user of the hearing device, and control the hearing device in accordance therewith, wherein the vibration sensitive transducer is secured to a shell of the hearing device so that vibrations are detected via a skull of the user of the hearing device.

* * * * *